US005564453A

United States Patent [19]

Steiner

[11] Patent Number: 5,564,453

[45] Date of Patent: Oct. 15, 1996

[54] APPARATUS FOR STATIONARY SCREENING

[76] Inventor: Walter Steiner, Saentisstrasse 52, CH-8311, Bruetten, Switzerland

[21] Appl. No.: 349,828

[22] Filed: Dec. 6, 1994

Related U.S. Application Data

[63] Continuation-in-part of Ser. No. 963,055, Oct. 19, 1992, Pat. No. 5,398,710.

[51] Int. Cl.[6] ..... F04H 15/28; A45B 19/06; A45B 25/18

[52] U.S. Cl. ..... 135/98; 135/26; 135/27; 135/33.2

[58] Field of Search ..... 135/19.5, 20.3, 135/25.34, 26, 27, 29, 31, 98, 25.31, 25.33, 33.2

[56] References Cited

U.S. PATENT DOCUMENTS

| | | | |
|---|---|---|---|
| 312,446 | 2/1885 | Drake | 135/33.7 |
| 360,294 | 3/1887 | Haitz | 135/31 |
| 540,098 | 5/1895 | Grove et al. | 135/27 |
| 858,967 | 7/1907 | Dimond | 135/33.2 |
| 990,329 | 4/1911 | Anderson | 135/31 |
| 1,174,116 | 3/1916 | Berman | 135/19.5 |
| 1,205,809 | 11/1916 | Steele | 135/26 |
| 1,737,464 | 11/1929 | Lillich et al. | 135/31 |
| 2,194,389 | 3/1940 | Haupt | 135/31 |
| 2,224,882 | 12/1940 | Peck | 135/98 |
| 2,571,634 | 10/1951 | Von Gunten | 135/31 |
| 2,775,977 | 1/1957 | Haupt | 135/31 |
| 3,017,893 | 1/1962 | Greenbie | 135/98 |
| 3,885,582 | 5/1975 | Kowalski | 135/33.7 |
| 4,865,063 | 9/1989 | Williams | 135/33.7 |
| 5,078,166 | 1/1992 | Lee | 135/33.7 |
| 5,115,827 | 5/1992 | Lee | 135/33.7 |
| 5,305,770 | 4/1994 | DeMarco | 135/26 |

FOREIGN PATENT DOCUMENTS

| | | | |
|---|---|---|---|
| 510130 | 10/1930 | Germany | 135/33.6 |
| 13554 | of 1851 | United Kingdom | 135/33.2 |

*Primary Examiner*—Michael Safavi
*Attorney, Agent, or Firm*—Ladas & Parry

[57] ABSTRACT

The apparatus has several carrying bars which can be spread in radial manner from a central headpiece (2) and several shielding flat elements (17, 18), which are in each case fixed between two carrying bars. The multipart construction of the carrying bars from longitudinally displaceable, interengaging bar elements (4, 5) makes is possible to slide flat elements (17, 18) over one another, so that the apparatus, when in use, can provide different shielding surface sizes starting from a compact, slid together and collapsed form. By sliding over one another limited light-transmitting flat elements, it is possible to individually adjust the shielding action.

26 Claims, 11 Drawing Sheets

APPARATUS FOR STATIONARY SCREENING

This is a continuation-in-part application of U.S. application Ser. No. 07/963,055, filed Oct. 19, 1992, now U.S. Pat. No. 5,398,710.

BACKGROUND OF THE INVENTION

The invention relates to an apparatus for screening, particularly a large-surface sunshade, with carrying bars pivotably fixed to a central headpiece for fixing a screening flat structure and with supporting bars for supporting the carrying bars in a position spread away from the central headpiece and whose inner end is connected by means of an articulation to a sliding body, which is displaceable on a guide element connected to the central headpiece.

Known apparatuses of this type suffer from the disadvantage that in the case of a large span width, such as is e.g. sought for restaurant gardens, in the folded up state there is a high, columnar structure at least corresponding to the length of the carrying bars and which can only be opened with difficulty due to the carrying bars which move outwards on spreading open. Tables or chairs close to it must be moved away beforehand.

The problem of the invention is to find an apparatus of the aforementioned type, which in the unfolded state allows an increase of its screening surface, but which in the folded up state is particularly compact and can be easily opened without being impeded by objects in the vicinity. In addition, an apparatus of such a type is to be found which, due to the basic construction principle offers numerous, new embodiments and use possibilities, which permit an optimum use adapted to local circumstances and the solar radiation.

SUMMARY OF THE INVENTION

According to the invention the apparatus for solving this problem is characterized in that the carrying bars comprise at least two bar elements in reciprocal sliding engagement, so that they can be lengthened on sliding apart and to each of the bar elements in reciprocal sliding engagement is fixed a different flat element of the flat structure, so that flat elements provided on the same carrying bar can be slid over one another.

As a result of the features according to the invention, on folding together the screen-like apparatus the carrying bars can be shortened to approximately half their length, so that a compact structure is obtained. When the apparatus is opened out the surface structures slid over one another can be used with different covering positions for screening or shielding against solar radiation, e.g. to differently filter the latter by limiting permeable or transmitting surface elements, in order to reduce wind forces and/or to ensure reliable shielding in the case of rain. Between the covering surface elements it is possible for air to circulate, so that when the sun is shining the heat produced under the apparatus is further reduced.

In order to facilitate the folding up of the apparatus to give a compact unit, the flat elements are preferably made from pleated flat material, so that the pleats of superimposed flat elements engage in one another on folding together.

A very esthetic, closed form is given to the compact unit of the apparatus in that in a preferred embodiment envelope surfaces are provided, which are located on the outer bar elements in this position.

The compact, closed shape of the apparatus can be further improved in that when it is constructed as a parasol the mast can be so further shortened until the ends of the carrying bars folded up parallel to the mast extend at least approximately to the ground or a base of the apparatus.

Further advantageous embodiments of apparatuses according to the invention which e.g. relate to the supporting of the bar elements and the nature of the fixing of the flat elements to the bar elements, can be gathered from the following description relative to the drawings and form the subject matter of the dependent claims.

Figure 5:
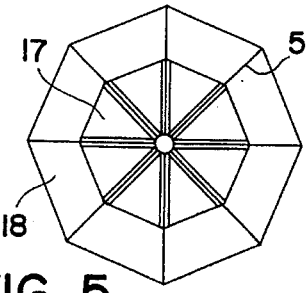
FIG. 5 A plan view of the apparatus in the fully open state.
Figure 18:
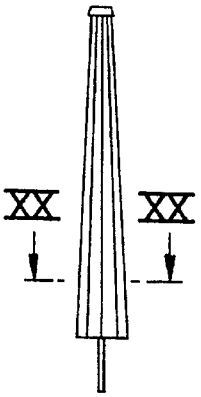
FIGS. 18 & 19 Views of the apparatuses in the folded up state.
Figure 19:
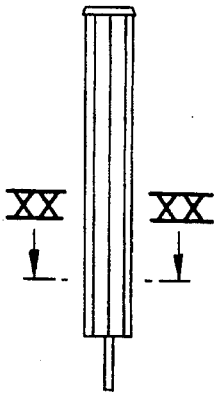
Figure 23:
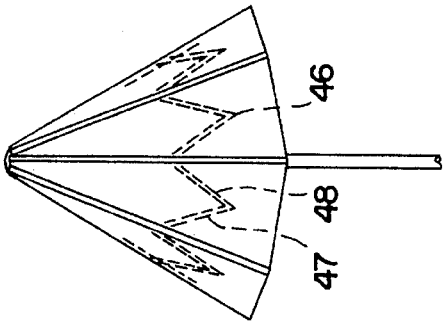
FIGS. 23 to 26 A side view and plan view of an apparatus for arrangement along a building wall in partly and completely opened state.
Figure 27:
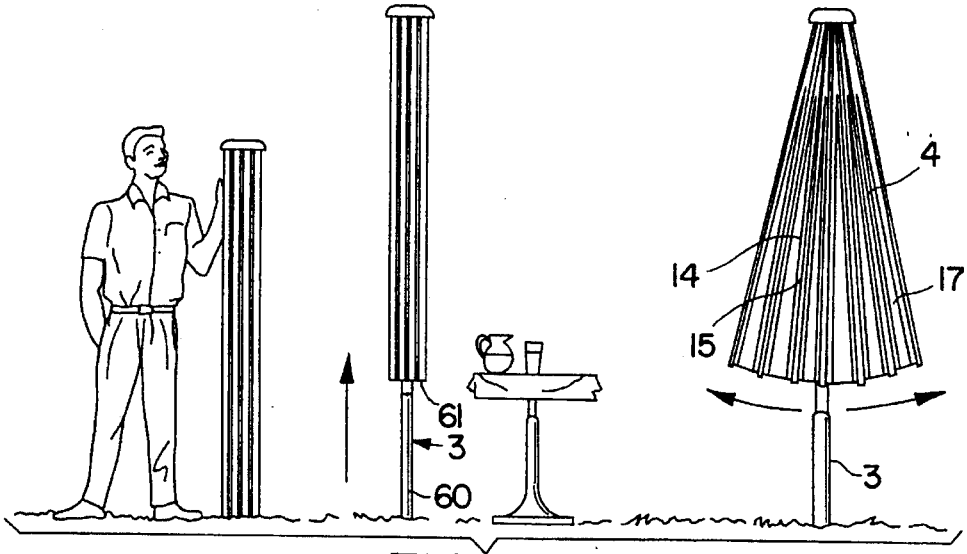
FIG. 27 A side view of a closed parasol showing the initial positions for initiating opening.
Figure 36:
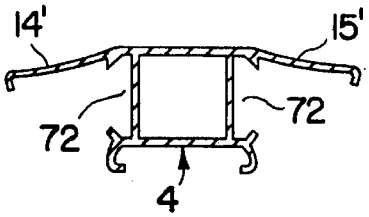
FIG. 36 A cross-section through an embodiment of a bar element with shaped on envelope profile parts.

The carrying bars 1, whereof there are e.g. eight, extend when the apparatus is spread out or open from a central headpiece 2, e.g. in slightly inclined manner, radially outwards and are connected thereto by a uniaxial joint or articulation, so that they can be pivoted downwards at least approximately parallel to one another in the form of a compact unit, e.g. in accordance with FIGS. 18, 19 and 27. The eight carrying bars 1 of the embodiment according to FIGS. 1, 2 or FIGS. 32 and 34 have in each case in the open state of the apparatus radially inner and outer bar elements 4, 5, which are displaceably guided on one another, in that in accordance with the sectional representation of FIG. 5 or FIG. 36 they comprise interengaging profile bars. The reciprocal engagement e.g. takes place in the form of a T cross-section, with a surrounding T-shaped hollow cross-section and a T-shaped engagement part 6, 6'. For forming elongated reception channels 7 to 12, the cross-section of the bar elements 4, 5 also has on either side outwardly open, e.g. c-shaped cross-sectional areas.

Figure 16:
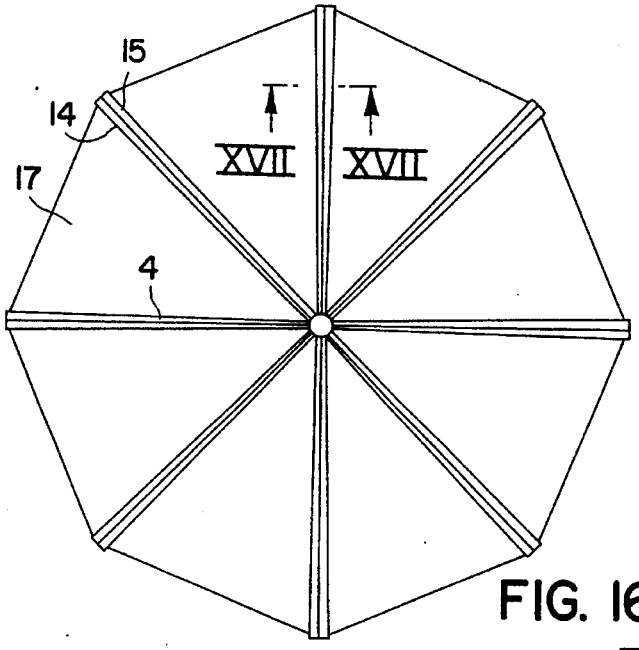
FIG. 16 A plan view of an apparatus opened in a first stage and with bearing envelope flaps.
Figure 17:
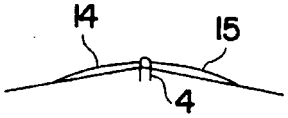
FIG. 17 A larger-scale partial cross-section along line XVII—XVII of FIG. 16.

The top or outer pair 7, 8 of reception channels of the inner bar element 4 are used for receiving the bead-like edge 13 (FIG. 15) of stiff shell elements 14, 15, e.g. made from aluminium, which together with the other shell elements 14, 15 held between in each case two carrying bars 1 form a closed envelope, which clad the parasol or sunshade in the closed state in accordance with FIGS. 18 and 19 and following the opening of the parasol in spaced manner rest on the latter. This is shown by the plan view of the apparatus according to FIG. 16 and in particular the associated cross-sectional representation of FIG. 17. Instead of being slightly pivotably mounted in reception channels, the shell elements can also be rigidly shaped in wing-like manner on either side of the particular bar element 4, as shown in the cross-sectional representation of FIG. 36.

Figure 15:
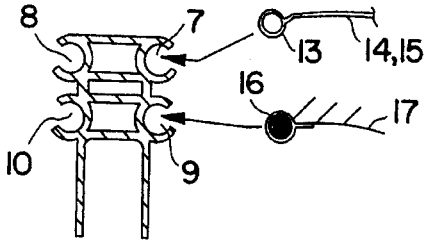
FIG. 15 A cross-section through a carrying bar for a non-enlargeable parasol with envelope flaps, e.g. according to FIGS. 16 and 17.

The remaining reception channels 9 to 12 of the embodiment according to FIG. 15 are used for receiving and holding an edge 16 of individual, triangular or trapezoidal, flexible flat elements 17, 18, e.g. in the manner of a welt engagement, such as is conventionally used for fixing the edges of awning surfaces.

As the edges of the flat elements 17, 18 in each case extend over the length of the bar elements 4, 5, in the case of the fully open parasol (FIG. 5), there is an overlap of the inner and outer flat elements 17, 18 within a remaining engagement area 20 between the bar elements 4, 5. As the radially inner flat elements 17 in the vicinity of the overlap are spaced over the radially outer flat element 18, which corresponds to the spacing determined by the size and design of the cross-section of the juxtaposed bar elements 4, 5 guided on one another between the reception channels 9 and 11 or 10 and 12, the apparatus has an all-round split aperture corresponding to this spacing and through which an air exchange can take place, so that the area below the screening surface of the apparatus is ventilated or vented.

The support bars 21 are connected in articulated manner with the radially outwardly slidable bar elements 5, so that when the apparatus is open to the maximum size there is a stable support by the far outwardly projecting support bars 21. In order that the support bars 21 and therefore the mast 3 do not have to be made correspondingly long and so that at the start of opening there are statically favourable angular positions of the support bars 21, the latter e.g. comprise two support bar elements 23, 24 interconnected by means of a joint 22. The inner support bar elements 23 articulated to the lower sliding body 25 are in each case additionally held by an auxiliary support bar 26 engaging between the ends thereof, in that the bar 26 is articulated to a second, upper sliding body 27 guided on the mast 3.

Figure 2:
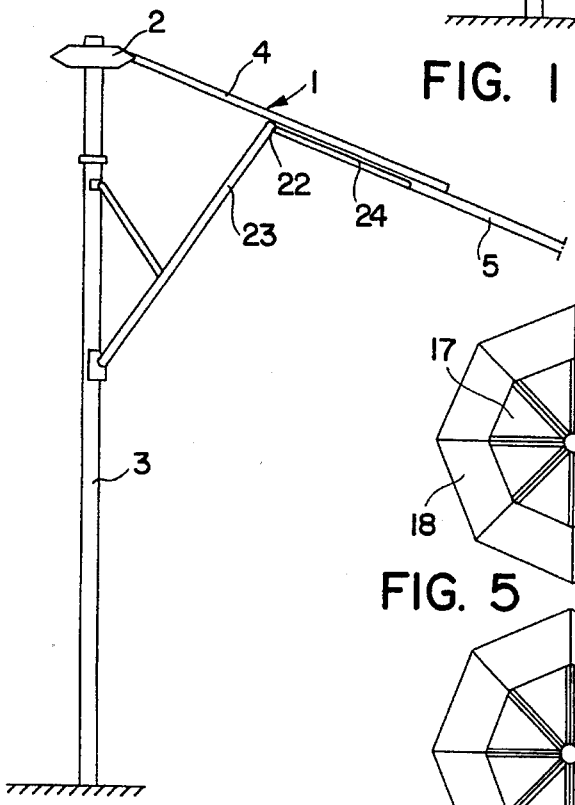
FIG. 2 An incomplete side view of the bar system according to FIG. 1 in the incompletely opened state.
Figure 6:
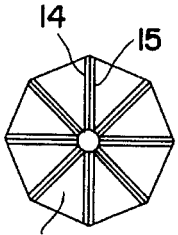
FIG. 6 A plan view of the apparatus according to FIG. 5 in a slightly opened state.
Figure 7:
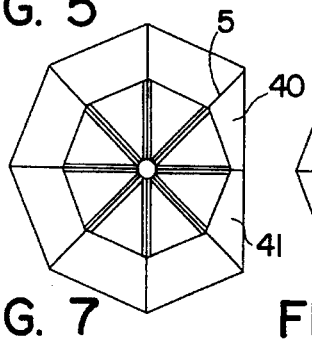
FIGS. 7 & 8 Plan views of the inventive apparatuses with varyingly long carrying bars, e.g. for placing along a wall.
Figure 8:
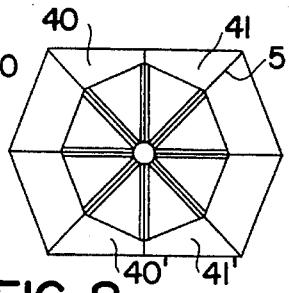

FIG. 2 illustrates a position of the support bar elements 23, 24, when the parasol is in a limited opening position (FIG. 6), where the parasol e.g. has a diameter of 3 m. On further sliding up the lower sliding body 25 the upper sliding body 27 is stopped on a stop member 28, so that the inner support bar element 23 pivots further outwards and assumes with respect to the displaceable element 5 an angular position in which the latter is slid outwards, so that the screening surface of the apparatus can be correspondingly continuously enlarged. A similar kinematics is also present in the embodiment according to FIG. 34.

Figure 3:
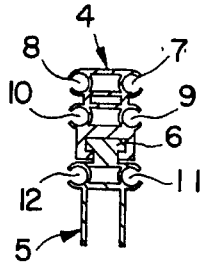
FIG. 3 A cross-section along line III—III of FIG. 1.
Figure 11:
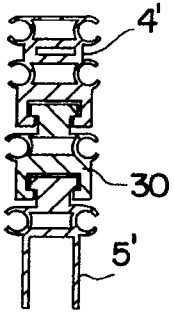
FIG. 11 A cross-section along line XI—XI in FIG. 10.
Figure 10:
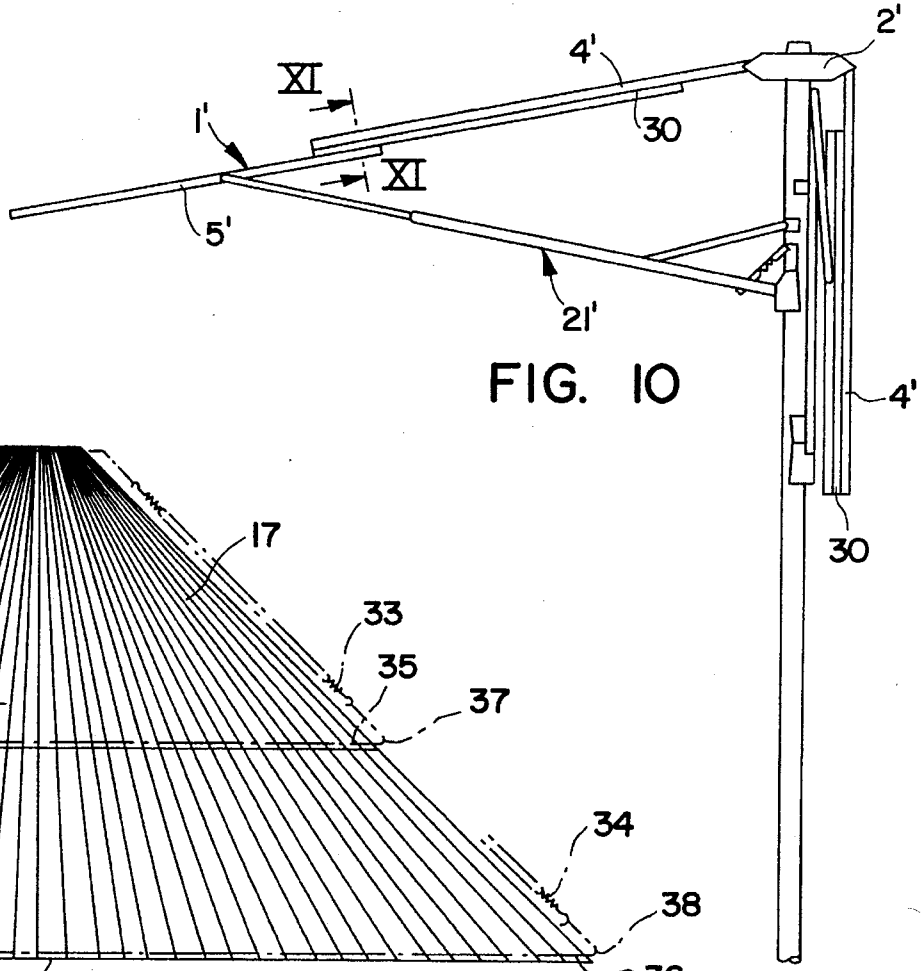
FIG. 10 A representation corresponding to FIG. 1 of an embodiment with in each case three carrying bar elements.
Figure 9:
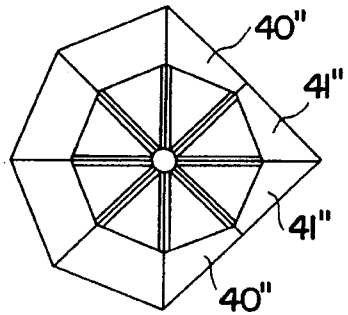
FIG. 9 An apparatus for positioning in the corner of a building.
Figure 12:
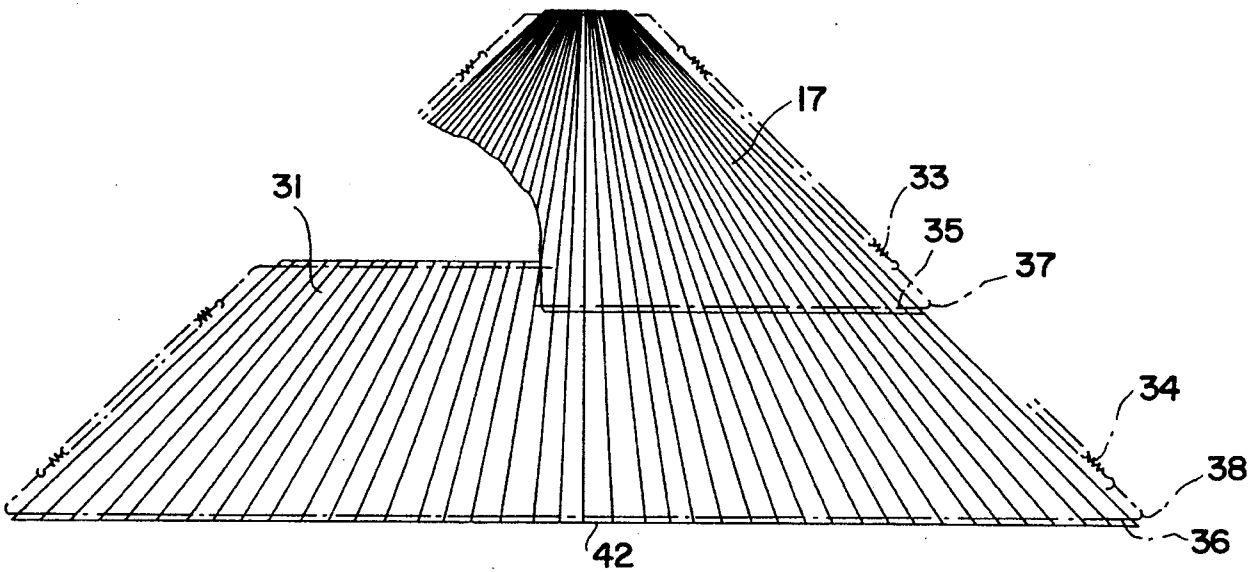
FIG. 12 A perspective view of two overlapping, pleated flat elements in the open state.
Figure 13:
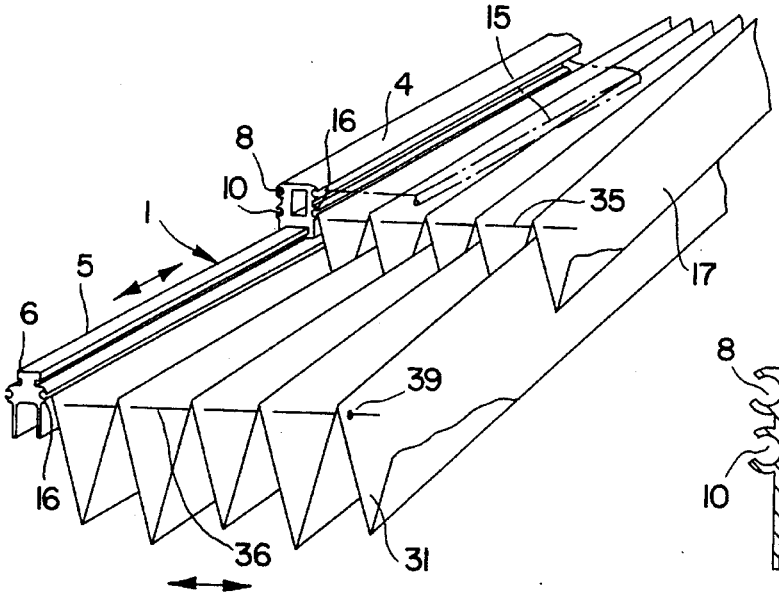
FIG. 13 A perspective view of an area of two overlapping flat elements in the incompletely opened state.
Figure 14:
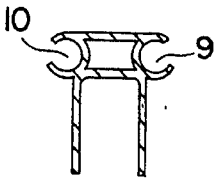
FIG. 14 A cross-section through a carrying bar of a non-enlargeable parasol, e.g. according to FIGS. 21 to 26.

The embodiment according to FIGS. 10 and 11 differs from that described hereinbefore substantially through a three-part construction of the carrying bars 1', in that between the lower bar element 5' connected to the support bar 21' and the upper bar element 4' articulated to the headpiece 2', there is a third bar element 30 which is in sliding engagement therewith. The cross-sectional representation according to FIG. 11 shows that this sliding engagement can be in accordance with the principle of the embodiment of FIG. 3. The central bar elements 30 guided between the two bar elements 4', 5' in this way can be slid outwards together with the flat elements 31 fixed thereto from the inner position shown in FIG. 10. Thus, their flat elements 31 are consequently covered in the inner position shown by those of the inner bar elements 4' and in the extended position the flat elements 31 cover those of the bar elements 5'. Between the two positions intermediate positions are continuously adjustable or settable. The different covering positions, which can also be made different for flat elements adjacent in the circumferential direction of the apparatus, consequently allow a better solar radiation screening adapted to local circumstances or the sun's position. The air layer between the superimposed flat elements 17, 31 or 18, 31 contributes to the good thermal insulation.

Preferably the central bar elements 30 guided between the bar elements 4', 5' are detachably connected to the bar elements 5', to which are connected the support bars 21'. Thus, these bar elements 30, if desired with the flat elements fixed thereto, in the case of a complete opening of the apparatus can be slid outwards by the support bars 21' together with the bar elements 5', e.g. in order to ensure a rain-tight shielding in the outer circumferential area of the apparatus. However, if the overlap or covering of the flat elements associated with the bar elements 5' and 30 is to be avoided in the outer circumferential area of the apparatus, then when the apparatus is incompletely opened the locking action between the bar elements 5' and 30 must be released. However, in place of this it can be produced between the bar elements 4' and 30. Locking can be achieved in the simplest way by a pressure screw or e.g. by a clamping lever, such as is e.g. conventionally used for the reciprocal locking of the legs of tripods.

The possible reciprocal overlap of the flat elements advantageously also permits the optional use of textile or sheet materials to a limited extent filtering sun rays, in order to allow a more careful suntanning. Then, for a more powerful screening action, by a partial sliding together of the parasol these more permeable flat elements 17, 18 are covered from above or below by another flat element 31.

Figure 4:
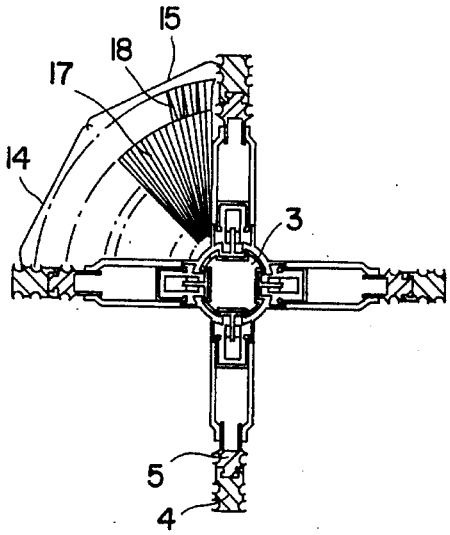
FIG. 4 A cross-section along line IV—IV of FIG. 1.
Figure 39:
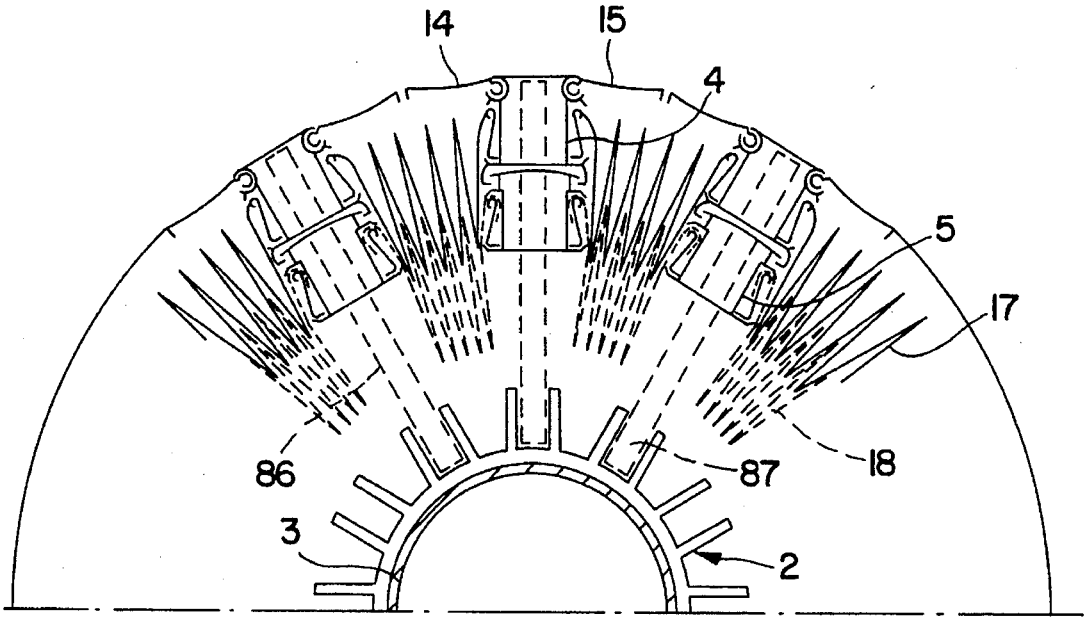
FIG. 39 A half cross-section through an apparatus in the vicinity of the central headpiece, with the bar elements according to FIG. 35 pivoted downwards parallel to the mast.
Figure 40:
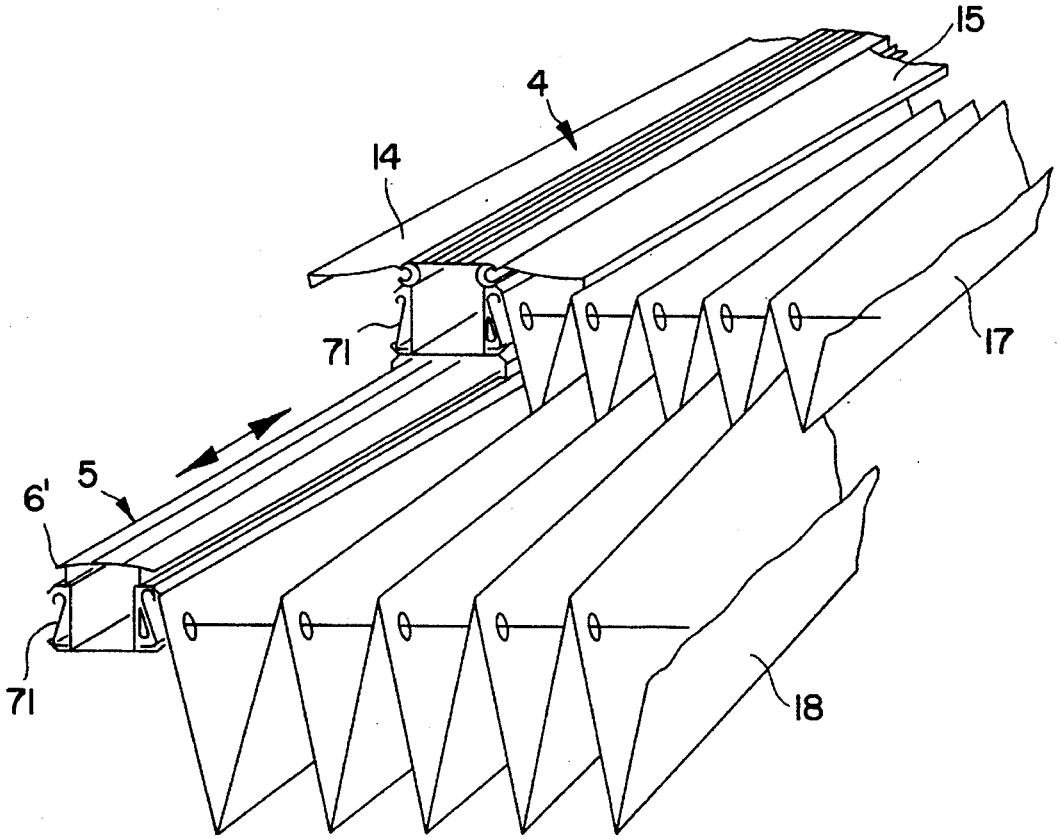
FIG. 40 A perspective view of a region of two overlapping flat elements with bar elements according to FIG. 35.

In order to avoid a sagging of the flat elements 17, 18, 31 in the case of an incomplete opening of the sunshade and in order to permit an easy closing of the latter to give a compact form, preferably they comprise pleated awning material or some comparable material, which in the relieved state with the apparatus folded up in accordance with the cross-sectional representations of FIGS. 4 and 39 assume a pointed, zig-zag cross-sectional shape. In addition, bracing cords 35, 36 connected to spring pulls 33, 34 extend between the carrying bars 1' in the circumferential direction of the apparatus. These spring pulls e.g. run along the carrying bars 1' and therefore along the lateral edges of the flat elements 17, 18, 31, so that reversing points 38 are provided in the corner areas. The connection to the flat elements 17, 18, 31 takes place by passing the bracing cords 35, 36 through holes or slots in their folding areas 39.

The subdivision of the flat structure used for shielding against the sun, wind, rain or undesired viewing, into individual, replaceable flat elements makes it possible to achieve the above-described, enlargeable and/or multi-layer design of a screening apparatus. They also permit in simple manner the obtaining of special flat structure shapes, as shown by the embodiments of FIGS. 7 to 9 and 21 to 26. The embodiments of FIGS. 7 to 9 can be brought about without any significant changes to the carrying linkage of the parasol, in that in at least one particular circumferential area thereof only outer flat elements 40, 41; 40', 41'; 40", 41" between outer bar elements 5 have a different blank shape and an outer bar element 5 is in each case shortened or lengthened.

Figure 22:
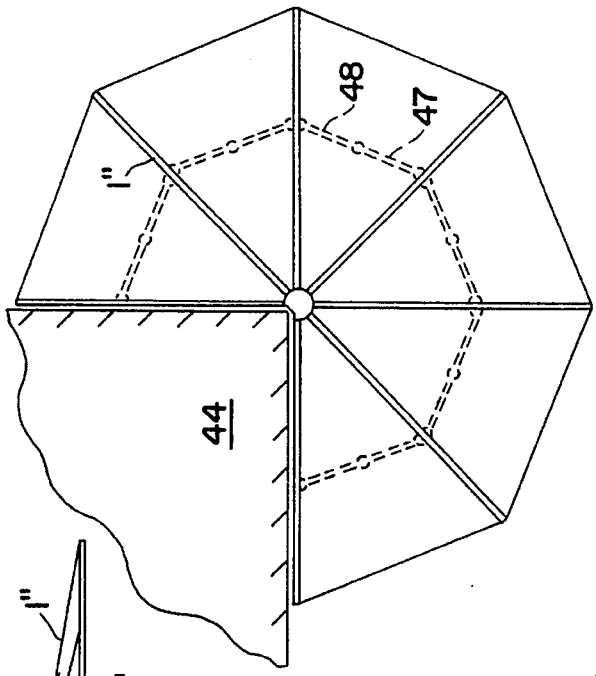
FIGS. 21 & 22 A side view and plan view of a rectangularly recessed apparatus for the inclusion of a corner of a building.
Figure 26:
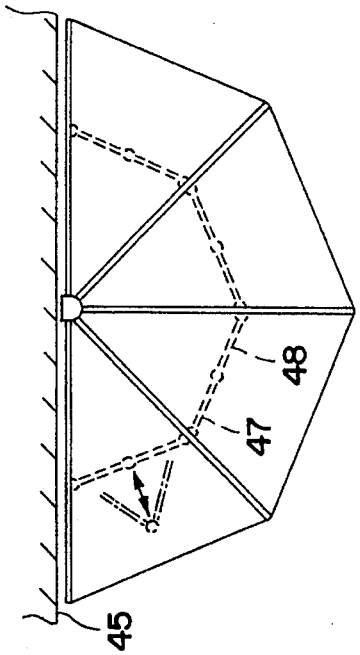
Figure 21:
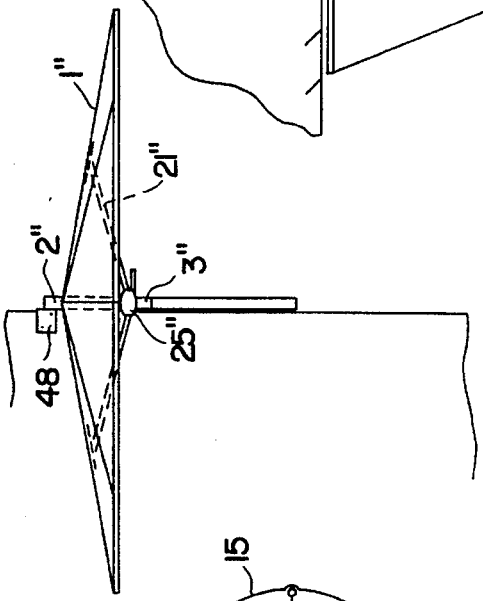
Figure 25:
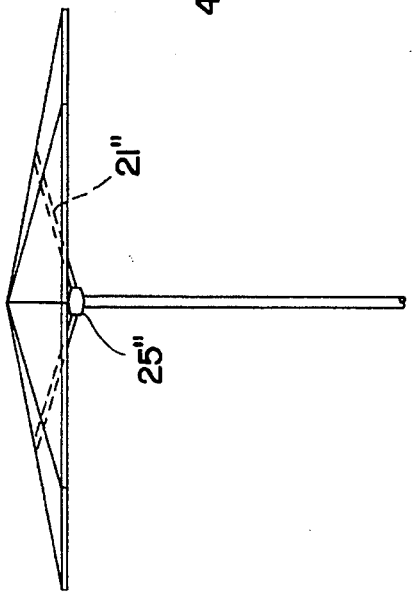
Figure 20:
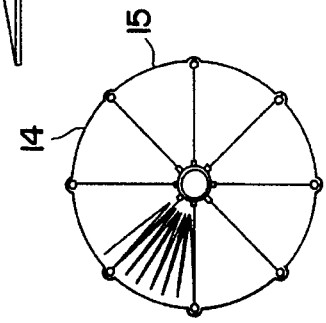
FIG. 20 A larger-scale cross-section along line XX—XX of FIGS. 18 or 19.
Figure 24:
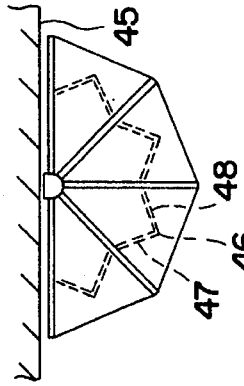

It is also possible to obtain screening or shielding apparatuses, which extend by less than 360° and have a corresponding cut out or away slope, so as to be able to e.g. pass round a house corner 44 with 270° in accordance with FIG. 22 or to be stretchable over 180° along a house wall 45 according to FIGS. 23 to 26.

For a particularly stable supporting of the carrying bars 1 it is recommended to have an additional spreading or opening mechanism, in accordance with FIGS. 21 to 26, in which the carrying bars 1 are articulated together by in each case two spreading or opening bars 47, 48 coupled together by a toggle joint 46, so that the screening flat structure has a more stable shape. For the easy opening of such an apparatus it is possible to use a conventional spreading or opening system with a sliding body 25" and support bars 21". The sliding movement of the sliding body 25" can be obtained by a cable line system guided over pulleys between the headpiece 2" and the sliding body 25". For this purpose the mast 3" need only have a length corresponding to the maximum sliding path, because such an apparatus can be fixed by means of a bracket 48 to the house wall or to some other supporting means.

Figure 1:
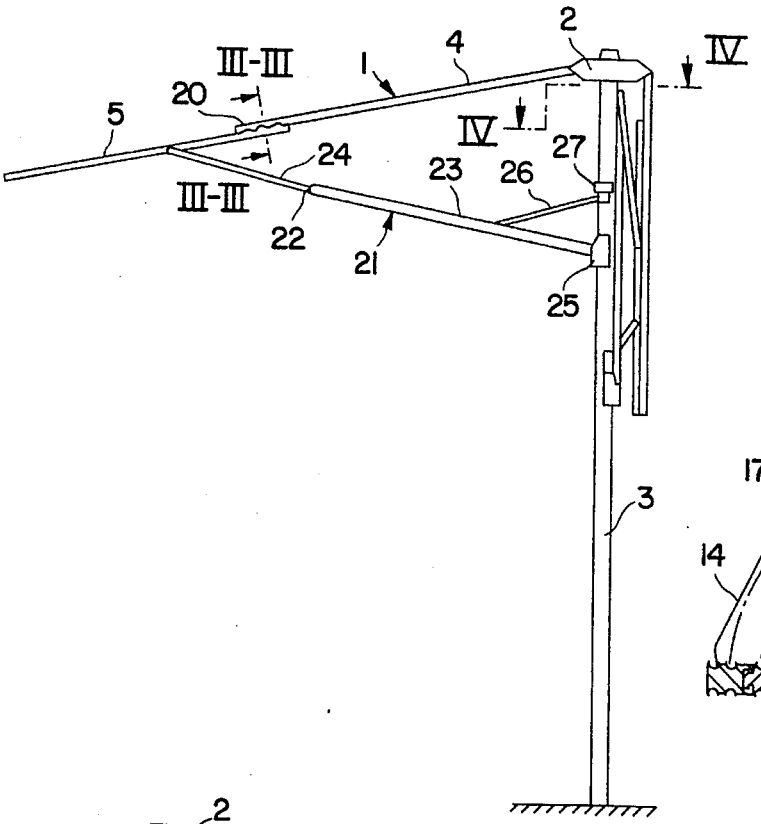
FIG. 1 A simplified side view of the bar system of an apparatus, in which one bar part is shown fully open and the other closed.
Figure 32:
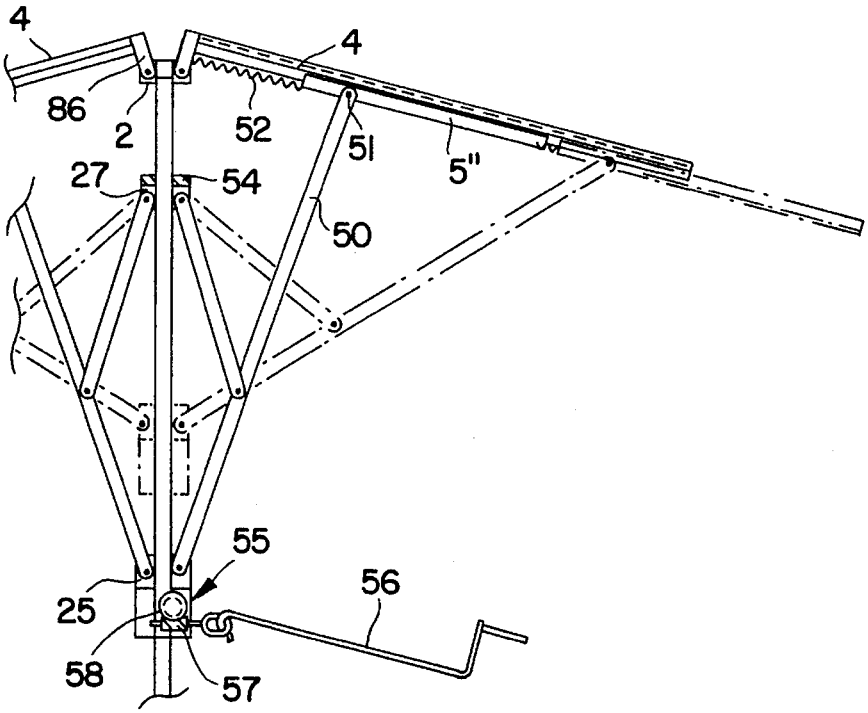
FIG. 32 A cross-section through the upper region of a parasol in a first opening position and with a further opening position indicated by dot-dash lines.
Figure 33:
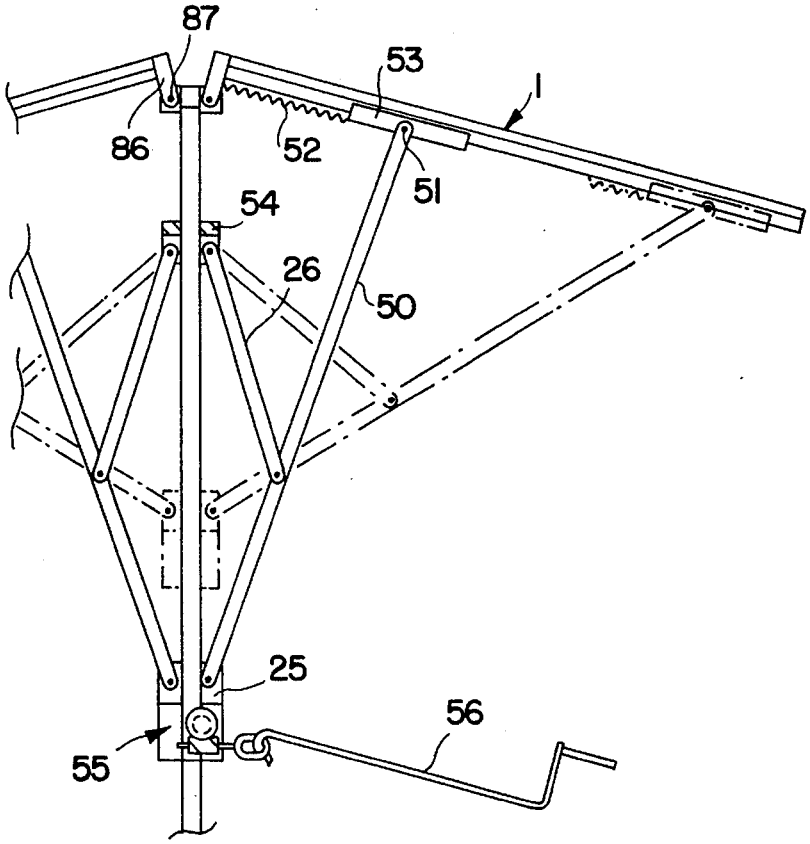
FIG. 33 A cross-section through the upper region of a parasol, whose carrying bars are supported by a sliding element.
Figure 34:
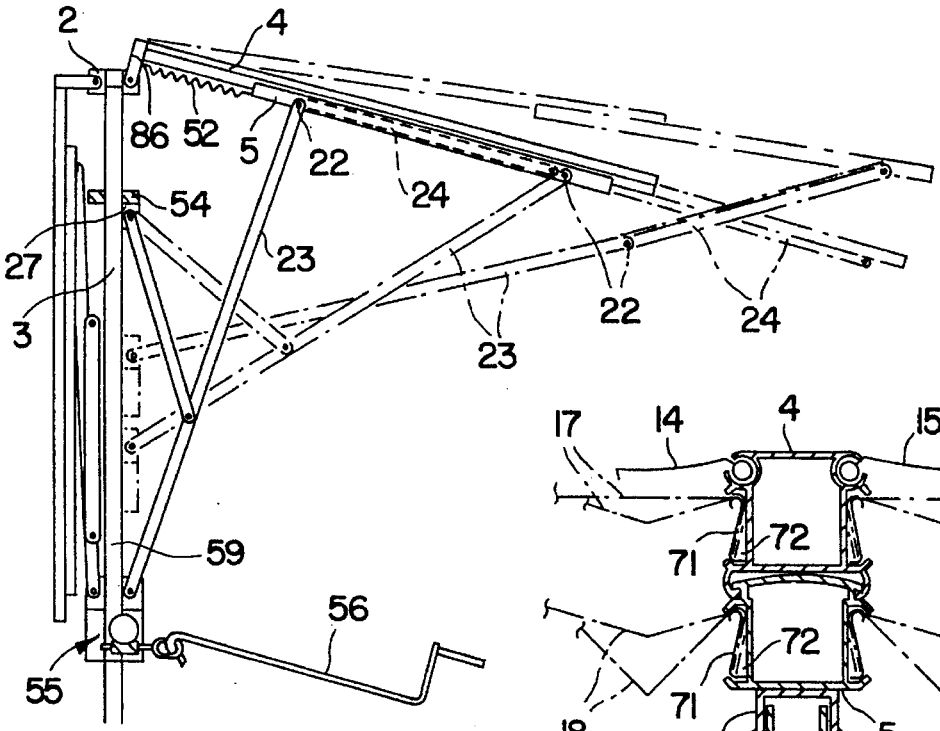
FIG. 34 A cross-sectional representation of another embodiment of a parasol with a spreading or opening mechanism according to FIGS. 1 and 2 and with two additional opening positions.

FIGS. 32 and 33 show an embodiment of the apparatus in which the support bars 50 are in one piece, unlike in the embodiments of FIGS. 1, 2 and 10. However, in order to still be able to move the support point on the joint 51 along the particular carrying bar 1 with increasing opening, the joint 51 for the support bar 50 is either provided according to FIG. 32 on the outwardly displaceable bar element 5 or, according to FIG. 33, on a relatively short sliding element 53, which is guided on the carrying bar 1 or on a bar element 4 or 5. On sliding up the lower sliding body 25 the carrying bars 1 are firstly pivoted upwards by the support bars 50. Then the upper sliding body 27 is stopped on a stop member 54 fixed to the mast 3. During a further upward movement of the lower sliding body 25 the support bars 50 pivot outwards in the manner of a scissor arm, so that the sliding elements 53 or the bar elements 5 are moved continuously outwards with the associated flat elements 18. The stability of the apparatus is greatly helped by the outwardly displaced support. FIG. 34 shows an embodiment with the kinematic system according to FIGS. 1 and 2 and broken and dot-dash lines show two further spreading or opening positions of the support bar elements 23, 24. As in the embodiments of FIGS. 32 and 33 the rearward movement of the bar element 5 and therefore also the rearward movement, opposite to the spreading open movement, of the support bar elements 23, 24 is facilitated by a tension spring 52, which is fixed between the head side ends of the bar elements 4, 5.

For the upward movement of the lower sliding body 25 preferably a rotary drive 55 is provided, which has a not shown electric motor or an elongated hand crank 56. The rotary drive 55 has a worm 57, which engages in a worm wheel 58. The latter drives either the pulley of a cable line 59 fixed in the upper region of the mast 3, or a gear, which engages with a rack extending along the mast 3.

In order to obtain a very compact structure in the completely collapsed state of the parasol, i.e. with downwardly directed carrying bars 1 shortened by sliding together and in accordance with the first position shown in FIG. 27, the mast is also telescopically extendable, so that prior to opening it can be moved upwards above table height with the end 61 of the slid together carrying bars 1. Preferably for said upward movement a rotary drive 62 is provided, e.g. with a driving worm 63 and a worm wheel 64. The latter drives an elevating spindle 65, which engages with a spindle nut 66, so that the latter can be moved up and down together with the shaft 68 fixed thereto and carrying the upper mast part 67. Therefore the apparatus can easily be opened, although the significantly outwardly moving carrying bars 1 would prevent a presence in the vicinity of the mast 3.

Figure 28:
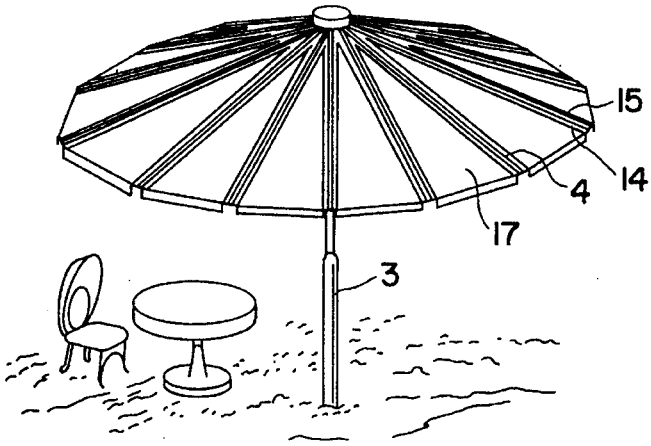
FIG. 28 A perspective view of the parasol according to FIG. 27 in a first opening stage.
Figure 29:
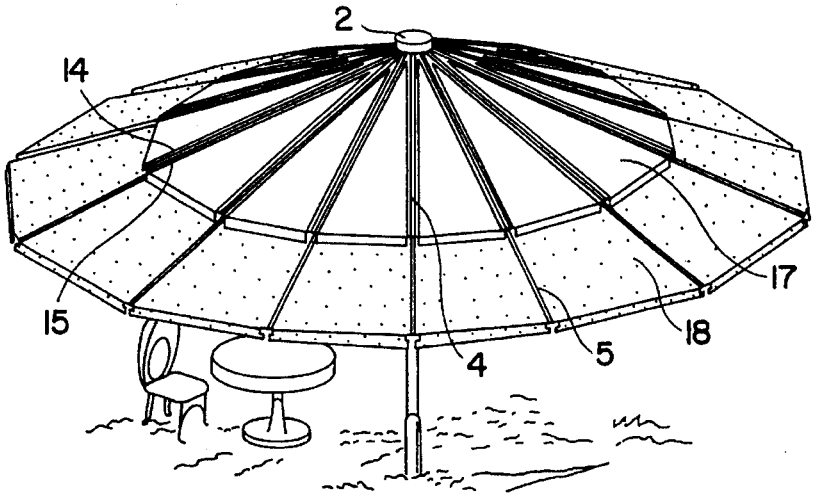
FIG. 29 The parasol according to FIG. 28 in a following, intermediate open position.

A parasol with a minimum span width of e.g. 4 m corresponding to FIG. 28 and a maximum span width of e.g. 8 m according to FIG. 29 can consequently, in the case of non-use, be reduced to a columnar, compact structure in accordance with the first position of FIG. 27, whose height is approximately only 2 m. Such a relatively short, columnar structure which, as a result of the envelope flaps 14, 15 enclosing the flat elements 17, 18 has a closed, esthetically attractive form, fits well into a garden arrangement or the like, whereas a folded up parasol of the known construction with a comparable span would, as a result of its height of 4 m, plus its free lower mast length, not normally be accepted for this purpose.

Figure 35:
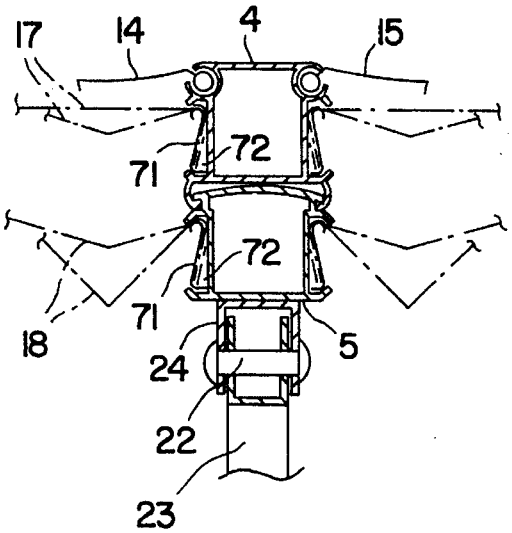
FIG. 35 A cross-section through two bar elements slid into one another of the parasol according to FIG. 34 with an engaging supporting bar element.

The cross-sectional representations of FIGS. 11 and 35 illustrate the fact that as a result of the superimposed arrangement of the bar elements 4, 5, the adjacent, triangular and trapezoidal flat elements 17, 18 in the circumferential direction of the apparatus, unlike in the case of conventional umbrellas cannot be sewn together to give a unitary flat structure and instead their individual, lateral fastening to the bar elements 4, 5 is necessary. For this purpose it is appropriate to have a fastening based on the welt principle shown in FIG. 5. However, this suffers from the disadvantage that the edge 16 of the flat elements 17, 18 must be drawn in its longitudinal direction into the reception groove 9, 10, so that it cannot be secured against displacement over its length and consequently a distortion of the flat elements can only be prevented in the vicinity of its fastened ends. In addition, a sewn in welt has the disadvantage that force concentrations occur at the seams, which in the case of permanent stressing can lead to the detachment or separation of the seem or damage to the flat elements 17, 18.

A preferred embodiment of the invention proposes, in accordance with that of FIGS. 35 to 40, the at least double-layer edge 70 of the flat elements 17, 18 resulting e.g. from loose folding or loose rolling in is secured by at least one strip-like blocking element 71 in a channel 72 of the bar element 4, 5. In said reception channel 72 in the position assumed by the blocking element 71 or due to the cross-sectional shape of the blocking element 71 between the latter and a channel wall 73 there is a gusset-like space 74, which encloses the at least double-layer edge of the flat element 17, 18.

Preferably the reception channel 72 bounded at its two cross-sectional ends by undercuts 75, 76 has a maximum width, which is sufficiently larger than the width of the strip-like blocking element 71, so as to permit in the tilted position an insertion of the blocking element 71 in the channel transversely to the longitudinal direction thereof. Therefore said width is greater than the maximum width of the blocking element 71 by at least the amount of one of the undercuts 76, plus the thickness of the flat elements 17, 18, as can be gathered from FIG. 37. This oversize of the width of the reception channel 72 compared with the width of the blocking element 71 can also be smaller. In this case the blocking element 71 is to be inserted from the channel end. Any significant oversize still present permits an easy insertion, without it being necessary to move in its longitudinal direction an e.g. previously inserted edge 70 of the flat element.

A pressing in of the strip-like blocking element 71 transversely to the longitudinal direction of the channel 72 is also made possible by its cross-section being resiliently deformable. The resilient deformability of the cross-section can result from at least one cross-sectional curvature 78. In the represented embodiment there are two oppositely directed curvatures or bends 78, 79 with a different radius at the cross-sectional ends. The flat element 17, 18 is guided over the upper curvature 78 having the larger radius, whereas the lower, oppositely directed curvature 76 has a supporting function, whilst receiving the edge 70 e.g. having two folds 80, 81. The oppositely directed curvatures 78, 79 of the blocking element cross-section lead to an upwardly inclined path of the central cross-sectional part 83 directed towards the bar element 4, 5, so that with the channel walls 73 is formed a gusset-like space 74.

The tensile stress on the flat elements 17, 18 due to the opening of the apparatus and which attempts to draw the same out of the gusset-shaped gap 74, on the one hand leads to the fixing of the at least double-layer edge 70 in the gap 74 and also to the fixing between the profile leg 84 forming an undercut and the upper curvature 78 of the blocking element 71. This clamping holding of the edge 70 of the flat elements 17, 18 leads to a reduced stressing of their material and therefore to a greater durability of the apparatus. Apart from the ease of manufacture and installation of this connection between a flat element 17, 18 and a bar element 4, 5 or a carrying bar 1, it also permits an easy replacement of individual flat elements 17, 18, in order to obtain special screening effects of the aforementioned type or achieve new aesthetic effects.

Figure 30:
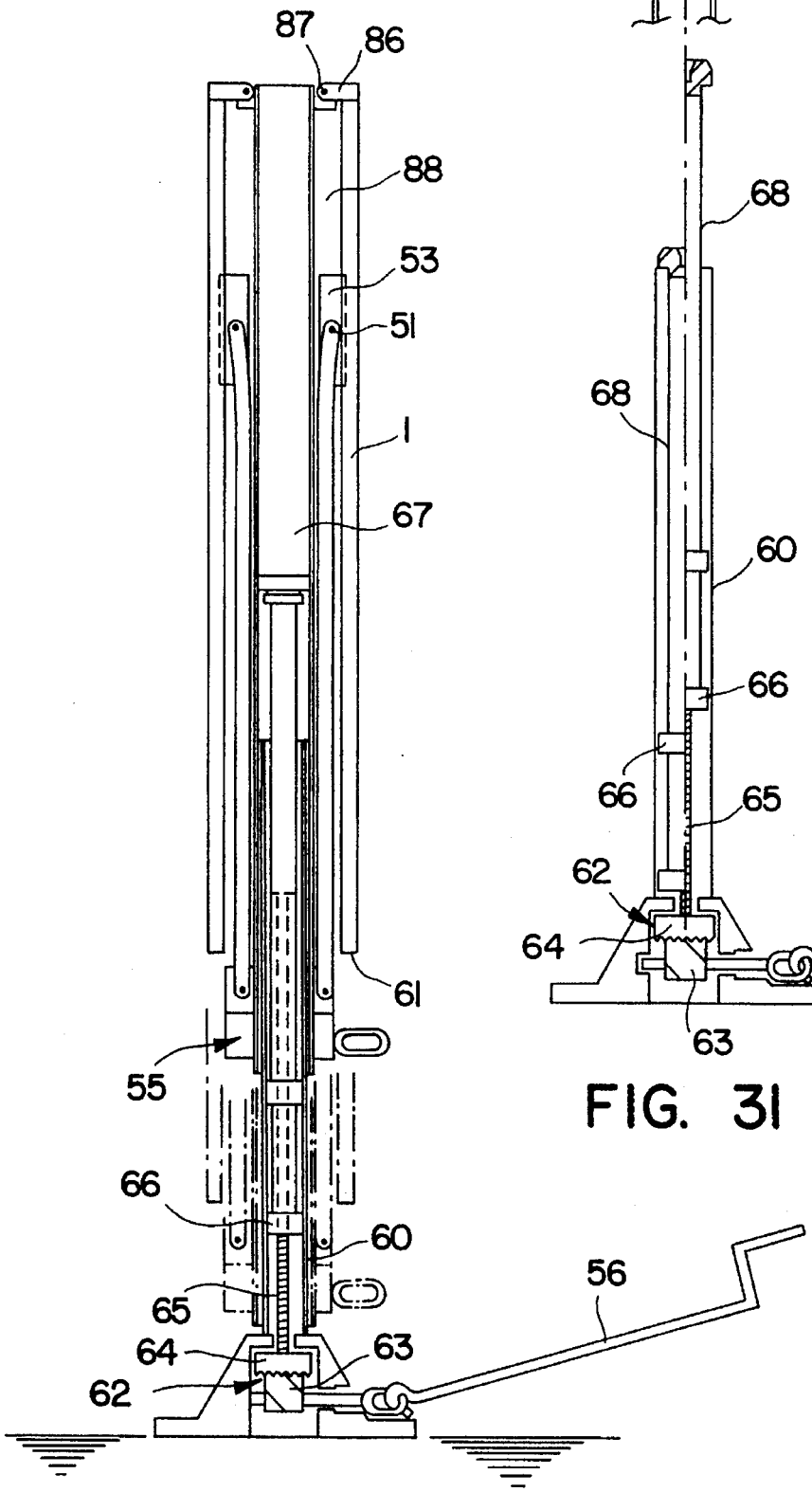
FIG. 30 A cross-section through the lower region of the parasol according to FIGS. 27 to 29 in the second position with raised mast.
Figure 31:
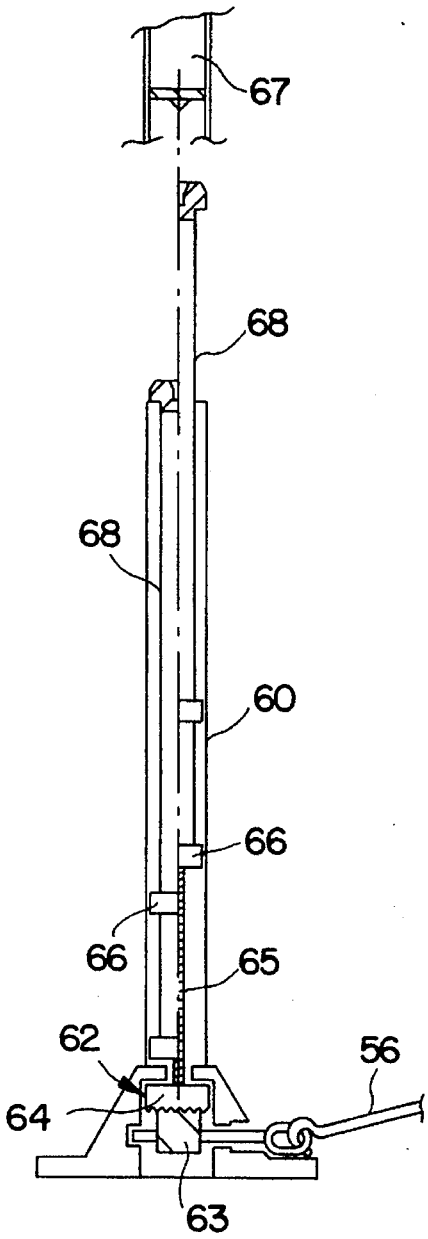
FIG. 31 A cross-section through the lifting mechanism of the parasol according to FIG. 30 with two half-shown lifting positions.

For a very central mounting of the carrying bars 1 or the bar elements 4 on a headpiece 2 of the apparatus and which kinematically facilitates its outward pivoting, they are provided with a head end 86, which is directed inwards in inclined manner or at right angles to the particular bearing 87. This leads to the lateral displacement of the axes of the bearings 51 and 87 shown in FIG. 30, which permits an outward pivoting of the carrying bars 1 or the bar elements 5 by the drive 55.

Figures 41, 42, 43:
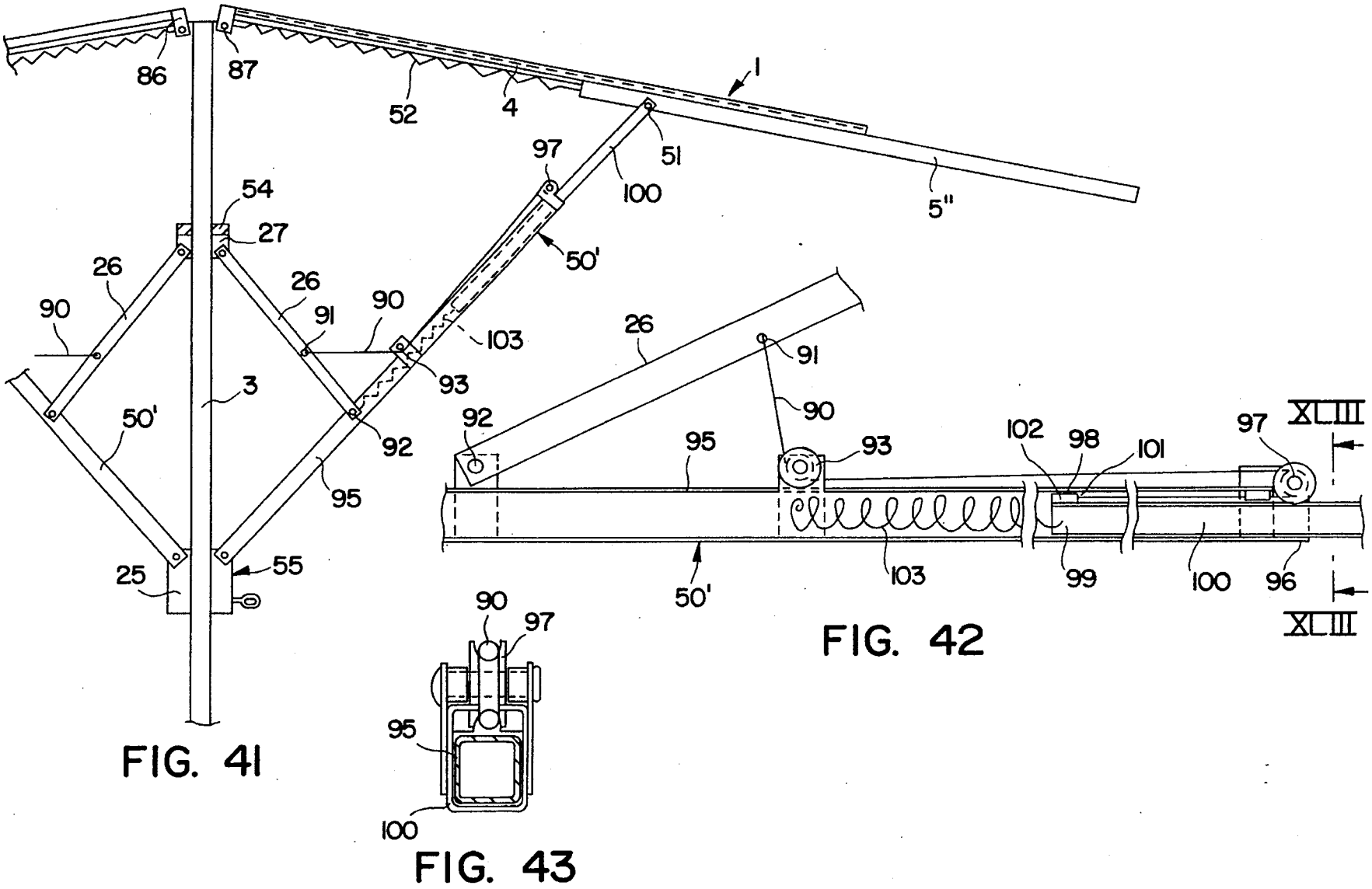
FIG. 41 An incomplete side view of the fully opened bar system of a preferred embodiment of the apparatus.
FIG. 42 A part of the bar system according to FIG. 41 with illustration of a part of an auxiliary bar and of a supporting bar.
FIG. 43 A cross-section through a supporting bar along line XLIII—XLIII of FIG. 42.

FIG. 41 shows a further development of the embodiment according to FIG. 32, in that the supports bars 50' are also connected by means of a joint 41 with an outwardly displaceable bar element 5" of the supporting or carrying bars 1. However, in order to be able to move the bar elements 5" further outwards for increasing the sunshade size than would be possible as a result of swinging out the support bars 50', in an advantageous development of the invention the support bars 50' are telescopically extendable by the expanding movement of the sunshade.

The drive for the telescopic support bar extension is provided by the shearlike expanding movement, which takes place between the auxiliary bar 26 and the support bar 50' during the upward movement of the lower sliding body 25 and on engagement of the upper sliding body 27 on the stop member 54. For this purpose a cable 90 or a band is fixed by one end 91, spaced from the joint 92, to the auxiliary bar 26 and is guided by a first pulley 93 fixed e.g. with the same spacing from said joint 92 and fixed to the support bar 50' or to its lower support bar element 95. The cable 90 is extended by means of a second pulley 97 fixed to the outer or upper end 92 of the lower support bar element 95 and after deflecting by 180° up to a fixing point 98 on the inner or lower end 99 of an upper support bar element 100. The upper support bar element 100 has a smaller cross-section than the lower support bar element 95, so that it is telescopically guided in the latter. A sliding and spacing body 102 can be fixed to the support bar element 100 at the fixing point 98 for the other end 101 of the cable 90 and on the inner wall of the other support bar element 95 is provided a second sliding and spacing body, in which the cable 90 is guided. In this way the cable 90 can be guided between the profile walls of both bar elements 95, 100.

With increasing upward movement of the lower sliding body 25 the first pulley 93 moves increasingly far away from the fixing point of the cable end 91 to the auxiliary bar 26, so that the resulting tension on the cable 90 leads to the upper support bar element 100 being drawn telescopically out of the lower support bar element. There is a corresponding extension of the support bar 50' so that the displaceable bar elements 5" of the carrying bars 1 can be moved further outwards to increase the sunshade size.

To facilitate the sliding and folding together of the sunshade, in accordance with the embodiment of FIG. 32, between the head ends 86 of the carrying bars 1 and the head-side end of the displaceable bar elements 5" of the carrying bars 1 tension strings 52 are provided. In the embodiment according to FIG. 41 this sunshade movement is facilitated by additional tension springs 103, which connect the lower end 99 of the upper support bar elements 100 with a further downwardly positioned point, e.g. on the joint 92 of the lower support bar element 95. Therefore these tension springs 103 operate in opposition to the tension of the cable 90 or the extension of the support bars 50'.

The sunshade kinematics described relative to FIGS. 41 and 42 can advantageously also be used for another sunshade, which is constructed in accordance with FIG. 33, i.e. without any extendibility of the carrying bars 1.

Figure 37:
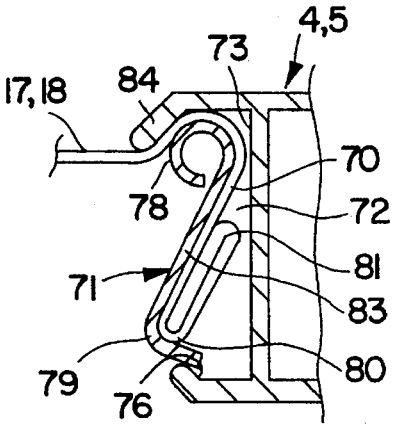
FIG. 37 A partial cross-section through a carrying bar with a flat element edge held therein with a position of the blocking element during installation.
Figure 38:
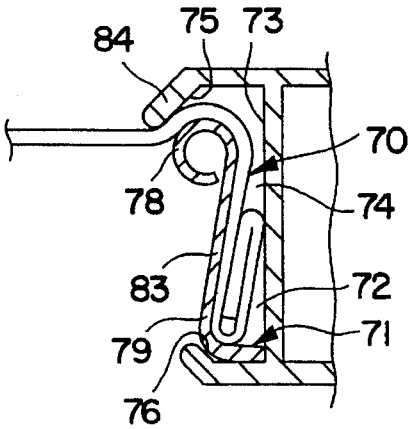
FIG. 38 The partial cross-section according to FIG. 37 with the completely inserted blocking element.
Figure 44:
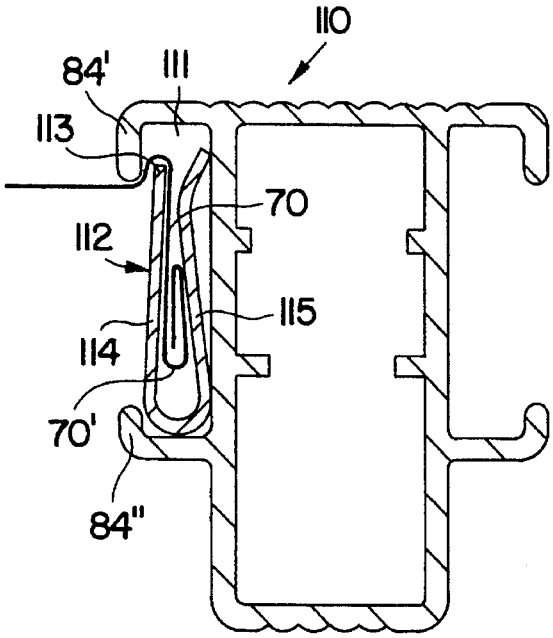
FIG. 44 A partial cross-section through an alternate carrying bar with a flat element edge held therein with a position of the blocking element completely inserted.
Figure 45:
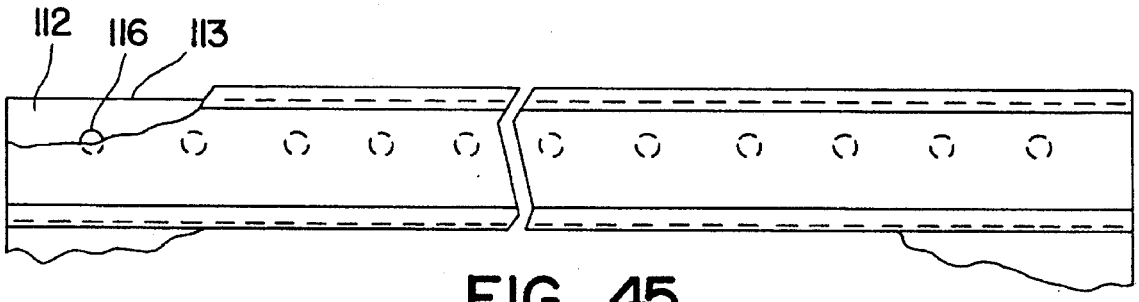
FIG. 45 A partial left side longitudinal view of the arrangement of FIG. 44 showing, in cutaway, the corrugated top edge of the blocking element.
Figure 46:
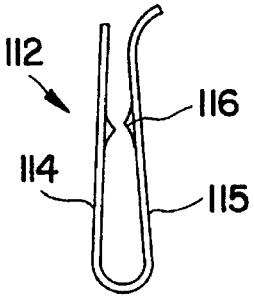
FIG. 46 An end edge view of the blocking element shown in FIGS. 44, 45 depicting spaced point-like depressions in the legs of the blocking element.

An alternate arrangement 110 of the blocking element arrangement shown in FIGS. 37 and 38 is shown in FIGS. 44–46. Initially, the folded edge 70' of a surface structure 70 is clamped into a strip-like blocking element 112 having a hair-pin cross-section. Different from the previously described embodiment according to FIGS. 37 and 38, the assembly of edge 70, 70' and blocking element 112 is inserted into the reception channel 111 in the longitudinal direction. The clamping attachment of the blocking element 112 to the folded edge 70' may be improved by providing point-like depressions formed by stamping of the two cross-sectional legs 114, 115 of the blocking element 112 at regular intervals over the length of the blocking element, thereby forming facing points 116 as shown in FIG. 46.

According to a preferred embodiment, the upper edge 78 (FIGS. 37, 38) and 113 (FIGS. 44, 45) of the blocking element 71, 112 is slightly corrugated or roughened longitudinally to avoid a lengthwise displacement of the edge of the (textile) surface structure.

It is obvious that the enlargeability of the described screen apparatuses is not only advantageous for large, stationary garden sunshades, but also in the case of small, portable parasols.

What is claimed is:

1. An apparatus for screening, particularly a large-surface sunshade, with carrying bars (1) pivotably fixed to a central headpiece (2) for fixing a screening structure, and with support bars (21, 47, 48, 50') for supporting the carrying bars (1) in a position spread away from the central headpiece (2) the inner end of each support bar being connected by means of an articulation to a sliding body means (25, 27) which is displaceable on an elongated guide element (3) connected to the central headpiece, wherein each of the carrying bars (1) comprises at least two bar elements (4, 5, 5', 5"), an inner bar element (4) and an outwardly displaceable bar element (5, 5', 5"), in reciprocal sliding engagement so that they can be lengthened on sliding apart, and to each of the bar elements (4, 5, 5', 5") in reciprocal sliding engagement is fixed a separate screen element (17, 18) of the screening structure, so that the screen elements (17, 18) provided on the same carrying bar (1) can be slid over one another, wherein:

on the guide element (3) are guided lower (25) and upper (27) sliding bodies;

to the upper sliding body (27) is fixed in articulated manner one end of a plurality of auxiliary barn (26) the other end of each auxiliary bar (26) being connected in articulated manner to a support bar (50');

on the guide element (3) is provided a stop member (54), spaced from the central headpiece (2), to limit the sliding movement of the upper sliding body (27) in the direction of the central headpiece (2);

the support bars (50') are connected in articulated manner with the outwardly displaceable bar elements (5", 53) of the carrying bars (1); and the support bars (50') comprise two bar elements (95, 100) telescopically guided in one another and on which are provided drive means (90, 93, 97) for the telescopic extension of the support bars (50').

2. An apparatus according to claim 1, wherein the different screen elements (17, 18, 31) fixed to each of the bar elements (4, 5) of one carrying bar (1) have different respective permeabilities with respect to solar radiation.

3. An apparatus according to claim 1, wherein:

the screen elements (17, 18) are made from pleated material with pleats directed radially to the central headpiece (2); and the pleats of the screen elements (17, 18) are slid over one another and interengage when the apparatus is folded.

4. An apparatus according to claim 3, comprising cord spring pulls (33 to 38), including a cord (35, 36) extending between two circumferentially adjacent carrying bars (1) and over a reversing point (37, 38) in the direction along the carrying bars, the screen elements (17, 31) being guided in the vicinity of their radially outer edge (42) in displaceable manner on the cord (35, 36).

5. An apparatus according to claim 1, wherein the screening structure comprises several individual screen elements (17, 18) having radial edges (16, 70), the screen elements (17, 18) being tightly fixed along their radial edges (16, 17) to a respective one of the bar elements (4, 5), each of the bar elements (4, 5) having a bar profile which has, on facing cross-sectional sides, reception channels (7 to 10, 72) having undercuts (75, 76) in which is held the radial edges (16, 70) of an adjacent screen element (17, 18).

6. An apparatus according to claim 5, wherein the radial edges (70) of the screen elements (17, 18) held in the reception channels (72) are thickened and are locked by at least one blocking element (71) inserted in each reception channel (72) in a gusset-like space (74) which is bounded by the blocking element (71) and one wall (73) of the reception channel (72), the blocking element (71) being in the form of a strip having, in cross-section, a rounded portion (78) over which is guided one radial edge of a screen element (17, 18).

7. An apparatus according to claim 6, wherein the edges (70) of the screen elements (17, 18) held in a reception channel (72) are thickened by at least a double fold (80, 81) of such edges.

8. An apparatus according to claim 6, wherein the strip-like blocking element (71) is provided at its longitudinal sides with oppositely curved bends (78, 79), so that the central cross-sectional area (83) connecting the bends (78, 79) in the reception channels (72) assumes an inclined position to the facing wall (73) thereof.

9. An apparatus according to claim 6, wherein the reception channel (72) has a width greater, by the amount of its lower undercut (76) and the thickness of the screen elements (17, 18), than the cross-section of the blocking element (71), so that the latter, together with the edge (70) of the screen element (17, 18), can be inserted and locked in the reception channel (72) in a direction transverse thereto.

10. An apparatus according to claim 1, wherein at least one envelope surface (14, 15) is fixed to each carrying bar (1) and extends along the carrying bar (1), so that, with the apparatus closed and with downwardly pivoted carrying bars (1), the envelope surfaces (14, 15) together form a closed protective envelope.

11. An apparatus according to claim 5, wherein, in the opened state, the screening structure extends over less than 360° for the arrangement of the apparatus immediately adjacent to a building (44, 45).

12. An apparatus according to claim 5, wherein the carrying bars (1) have different lengths, so that several screen elements (40', 41'; 40", 41") adjacent to one another in the circumferential direction have a different shape.

13. An apparatus according to claim 1, wherein the cross-section of the engagement of the bar elements (4, 5) is T-shaped.

14. An apparatus according to claim 1, wherein adjacent carrying bars (1") are connected by two spreading support bars (47, 48) coupled by means of a toggle joint (46), said spreading support bars (47, 48) being substantially in-line with one another in the extended position of the apparatus.

15. An apparatus according to claim 1, wherein:

the support bars (21) are connected in articulated manner to the outwardly displaceable bar elements (5) of the carrying bars (1);

said sliding body means (25) includes lower and upper sliding bodies (25, 27) guided on the guide element (3), and an auxiliary bar (26) connected to the upper sliding body (27) by means of a joint fixing one end of the auxiliary bar (26) whose other end is connected in articulated manner with one of the support bars (21); and a stop member (54) is provided on the guide element (3) said stop member (54) being spaced from the central headpiece (2) and adapted to stop the lifting movement of the upper sliding body (27).

16. An apparatus according to claim 15, wherein each support bar (21) comprises two support bar elements (23, 24) interconnected by means of a joint (22), so that the radially outer support bar element (24) during a first spreading or opening phase of the apparatus laterally engages the outwardly displaceable bar element (5), and during a second spreading or opening phase said radially outer support bar element (24) moves outwardly to, in turn, displace the outwardly displaceable bar element (5) together with the screen element (18) fixed to the outwardly displaceable bar element (5).

17. An apparatus according to claim 1, wherein the guide element is a mast (3) of the apparatus, whose lower region (60) has two mast elements (60, 68) telescopically guided on one another, and one of the mast elements (60) is adapted to be fixed relative to the ground, and the other mast element (68) is connected to a rotary drive lifting mechanism (65).

18. An apparatus according to claim 15, wherein the lower sliding body (25) to which the support bars (21) are fixed is connected to a lifting mechanism having a rotary drive (55), and in which one end of the support bars (21) are connected by means of a joint (51) to the outwardly displaceable bar element (5) of the carrying bars (1), so that the span width of the apparatus can be varied by the rotary drive.

19. An apparatus according to claim 1, wherein the carrying bars (1) or the bar elements (4) pivotably fixed to the central headpiece (2) have a transversely oriented head end (86) directed towards, and pivotally mounted on, the headpiece (2) of the apparatus.

20. An apparatus according to claim 1, wherein:

the bar elements (95, 100) comprise an upper bar element (100) and a lower bar element (95), each of the elements (95, 100) having upper and lower ends; and the drive means comprises a flexible tension element (90) guided by means of two pulleys (93, 97), one of the pulleys (97) being fixed to the upper end of the lower bar element (95) and the other pulley (93) is also fixed to the lower bar element (95) and is spaced from a joint (92) which connects the auxiliary bar (26) to the lower bar element (95), one end (91) of the tension element (90), spaced from the joint (92), being fixed to the auxiliary bar (26) and the other end (101) of the tension element (90) being fixed to the lower end (99) of the upper bar element (100).

21. An apparatus according to claim 6, wherein the rounded portion (78) of the blocking element (71) is corrugated or roughened along its length to avoid lengthwise displacement of the edge (70) of the screen elements (17, 18).

22. An apparatus according to claim 5, comprising at least one blocking element (92) having a hair-pin shaped cross-section with spaced legs (94, 95), wherein the edges (70, 70') of the screen elements (17, 18) held in the reception channels (91) are thickened and are locked by the at least one blocking element (92), inserted in each reception channel (91), in the space between the legs (94, 95), one radial edge (70) of a screen element (17, 18) being guided over the end of one of the legs (94), the blocking element (92) being in the form of an elongated strip.

23. An apparatus according to claim 22, wherein the end of the leg (92) over which a screen element (17, 18) is guided is corrugated or roughened along its length to avoid lengthwise displacement of the edge (70) of the screen elements (17, 18).

24. An apparatus according to claim 22, wherein the blocking element (92) has regularly spaced point-like depressions along at least one leg (94, 95) to form inwardly directed points (96) for improved attachment of the edge (70') of the screen elements (17, 18) to the blocking element (42).

25. An apparatus for screening, particularly a large-surface sunshade, with carrying bars (1) pivotably fixed to a central headpiece (2) for fixing a screening structure, and with support bars (50, 50') for supporting the carrying bars (1) in a position spread away from the central headpiece (2) the inner end of each support bar being connected by means of an articulation to a sliding body means (25) which is displaceable on a guide element (3) connected to the central headpiece, wherein the outer end of each of the support bars (50, 50') is connected by means of a joint (51) to a sliding element (5", 53) which is guided on one of the carrying bars (1), wherein:

on the guide element (3) are guided a lower sliding body (25) and an upper sliding body (27), and to the upper sliding body (27) are articulated auxiliary bars (26) each fixed at one end to the upper sliding body (27) and each connected at the other end in articulated manner to one of the support bars (50, 50');

to the guide element (3), spaced from the central headpiece (2), is fixed a stop member (54) for limiting the sliding movement of the upper sliding body (27) in the direction of the headpiece (2);

the support bars (50') are connected in articulated manner with the sliding elements (5", 53) of the carrying bars (1); and wherein the support bars (50') comprise two bar elements (95, 100) telescopically guided in one another and on which are provided drive means (90, 93, 97) for the telescopic extension of the support bars (50').

26. An apparatus according to claim 25, wherein:

the bar elements (95, 100) comprise an upper bar element (100) and a lower bar element (95), each of the elements (95, 100) having upper and lower ends; and the drive means comprises a flexible tension element (90) guided by means of two pulleys (93, 97), one of the pulleys (97) being fixed to the upper end of the lower bar element (95) and the other pulley (93) is also fixed to the lower bar element (95) and is spaced from a joint (92) which connects the auxiliary bar (26) to the lower bar element (95), one end (91) of the tension element (90), spaced from the joint (92), being fixed to the auxiliary bar (26) and the other end (101) of the tension element (90) being fixed to the lower end (99) of the upper bar element (100).

* * * * *